US006537737B1

(12) United States Patent
Wagner

(10) Patent No.: US 6,537,737 B1
(45) Date of Patent: Mar. 25, 2003

(54) METHOD AND APPARATUS FOR RESTORING FADED COLOR FILM AND ENHANCING BLACK AND WHITE FILM

(76) Inventor: George E Wagner, 1740 North Ave. 53, Los Angeles, CA (US) 90042

( * ) Notice: Subject to any disclaimer, the term of this patent is extended or adjusted under 35 U.S.C. 154(b) by 0 days.

(21) Appl. No.: 09/991,682

(22) Filed: Nov. 26, 2001

(51) Int. Cl.[7] ..... G03C 5/28; G03C 7/46
(52) U.S. Cl. ..... 430/359; 430/361
(58) Field of Search ..... 430/359, 361

(56) References Cited

PUBLICATIONS

Abstract of JP63119385A, May 1988.*

* cited by examiner

*Primary Examiner*—Hoa Van Le
(74) *Attorney, Agent, or Firm*—J. E. Brunton, Esq

(57) ABSTRACT

A method and apparatus for restoring and enhancing both color and black and white motion picture films. In accordance with the method of the invention, vapors emitted from a heated chemical solution, but is not, at any time, immersed into the chemical solution. The identical process is used in enhancing both color and black and white films. Enhancement of black and white films in accordance with one form of the invention includes an expansion of the contract range of the film, turning murky grays into deep blacks, bringing out textures in set and costume design, and revealing artistic lighting effects that were either muted or lost. Optical soundtracks on black and white films are also improved by the method of the invention.

11 Claims, 1 Drawing Sheet

METHOD AND APPARATUS FOR RESTORING FADED COLOR FILM AND ENHANCING BLACK AND WHITE FILM

BACKGROUND OF THE INVENTION

1. Field of the Invention

The present invention relates generally to a method and apparatus for restoring and enhancing film. More particularly, the invention concerns a method and apparatus for the restoration and enhancement of faded color or reduced contrast black and white motion picture films.

2. Discussion of the Prior Art

Motion pictures have come to represent an important part of our cultural heritage, and like some other art forms, their restoration and preservation presents substantial challenges to the archivist. One of the most serious problems inherent in color motion picture films is dye fading. Particularly devastating is the color fading of films produced by the Eastman Color process. The well-known Eastman Color process was introduced in the early 1950s and ultimately supplanted the black and white films as well as the dye transfer Technicolor films that were the principal film systems in use during this period. The Eastman Color film, starting at mid-century, eventually became the principal system for producing the motion pictures that were exhibited in theaters around the world up to the present day.

By the 1960s, it became apparent that the dyes of the Eastman Color films, both positive and negative were inherently unstable. With the passage of time, positive prints typically faded to a pallid red, with some very washed-out yellow, and virtually no blue. This undesirable fading characteristic was especially true of films that were stored at room temperature or above.

In the early 1980s, the Eastman Kodak Company reformulated Eastman Color to provide improved color stability, but there remained several decades of film making suffering from varying degrees of color fading.

The usual way the color film fading problem is dealt with by film laboratories is to produce new prints from faded negatives by using filters that add yellow to these prints and that restore, to some extent, natural skin tones. However, this technique is less than completely satisfactory and the viewer of the reprinted film experiences the motion picture through a yellow haze.

With regard to black and white motion picture films, which include many of the great films of the past, a problem often encountered is a limited contrast range. Films intended to have a rich range of contrast, including jet-blacks, exhibit only an assortment of pallid grays. This can occur in either positive or negative films. This undesirable reduced contrast range can be attributed to a number of factors.

Until about 1950, theatrical motion pictures were photographed on highly flammable, chemically unstable nitrate film stock. Much of this film has turned to dust, or been lost in fires. This, coupled with the need to protect the important nitrate elements that remain, has resulted in the films of the past typically being printed several generations away from the camera negative. Black and white films made after 1950 on safety stock are also typically printed generations away from the original negative, as these original elements could sustain damage if subjected to repeated use.

As a general rule, in copying motion pictures or photographs, contrast is reduced to preserve gradations of tone. While special film stocks used in copying are designed to preserve the quality of the original photography as much as possible, there are inevitably significant losses, and a wide contrast range is often sacrificed in order to retain subtle gradations. Not only is the picture area affected by this compromise, but also the optical sound tracks of black and white films, which can suffer from under exposure in printing and development. This can result in distortion and excess noise being heard on playback. If the films are to be exhibited through electronic means, on cable television, DVDs or the like, these problems can be lessened to some extent by digital or other electronic processing, but this is generally considerably less desirable than making improvements in the original track itself.

In dealing with the various problems of motion picture color, contrast, and sound, the prior art has failed to disclose or remotely suggest the novel processes of the present invention, and, therefore, is generally irrelevant. For example, U.S. Pat. No. 4,717,646 that relates to the restoration or color correcting of color photographs by the hand application of colors is of little pertinence to the present invention since it discloses techniques that are not applicable to motion pictures.

U.S. Pat. No. 5,796,874 that relates to the restoration of faded images by means of conforming the faded image to a restoration model using a computer program similarly lacks pertinence since it teaches a completely different approach to the solution of the problem of film restoration.

U.S. Pat. No. 3,643,569 that involves color restoration by filters rather than improvement of the films themselves, is also generally irrelevant, and discloses a process different from that of the present invention.

SUMMARY OF THE INVENTION

It is an object of the present invention to provide a method and apparatus for restoring and enhancing motion picture films.

Another object of the invention is to provide a method and apparatus of the aforementioned character that will restore and enhance both color and black and white motion picture films.

Another object of the invention is to provide a method as described in the preceding paragraphs in which the motion picture film is controllably exposed to vapors emitted from a heated chemical solution, but is not, at any time, immersed into the chemical solution.

Another object of the invention is to provide a method for enhancing the optical soundtracks on black and white motion picture films.

A particular object of the invention is to provide a method and apparatus for restoring the color balance of faded Eastman Color motion picture films manufactured by the Eastman Kodak Company; as well as films employing the same essential technology manufactured by others.

By way of summary, the present invention comprises a process through which, by chemical treatment and exposure to light, Eastman Color motion picture films, both negative and positive, of any vintage, can be restored to their original color values, and, additionally, black and white motion picture films, both negative and positive, of any vintage, can be enhanced by an expansion of their contrast range. The identical process is used in enhancing both color and black and white films. Enhancement of black and white film in accordance with one form of the invention includes an expansion of the contrast range of the film, turning murky grays into deep blacks, bringing out textures in set and costume design, and revealing artistic lighting effects that were either muted or lost. Optical soundtracks on black and white films are also improved by the method of the invention. In this regard, under exposed or under developed soundtracks are brought to a state of higher definition. Variable area soundtracks are sharpened in focus, and heightened in contrast, resulting in a track of lower distortion and higher signal to noise ratio. Additionally, variable density tracks are enhanced to reveal all the subtleties of their tonal gradations, with better defining of where those gradations begin and end. This results in lower distortion, greater clarity, and more naturalness when the soundtrack is reproduced.

DESCRIPTION OF THE INVENTION

Figure 1:
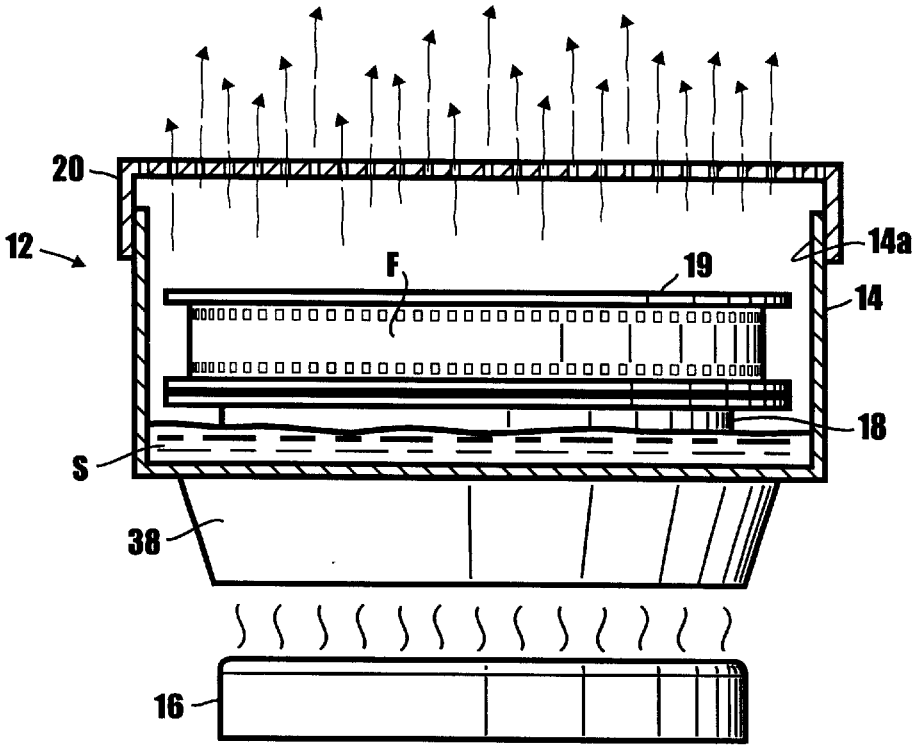
FIG. 1 is a side elevational cross-sectional view of one form of the assemblage of the apparatus of the invention for exposing the motion picture film to chemical vapors.

Referring to the drawings and particularly to FIG. 1, one form of the assemblage of the apparatus of the invention for exposing a motion picture film to chemical vapors is there shown and generally designated by the numeral 12. This apparatus comprises a top open container 14 for containing a volatile solution "S", heating means for controllably heating the container to controllably heat the solution and support means for supporting the motion picture film above the container. The heating means here comprises a conventional heater or heating unit 16 that may be either electrically powered or may use flammable gases. The support means can take various forms but is here shown as a generally cylindrically shaped support member 18 that rests on the bottom of container 14 and is partially immersed in the solution "S". As shown in FIG. 1 the film to be treated is loosely wound on a conventional house reel 19 that is supported on support member 18 in the manner shown in FIG. 1. Also forming apart of assemblage 12 is a perforated cover 20 that is received over the open end 14A of container 14 in the manner shown in FIG. 1.

Figure 2:
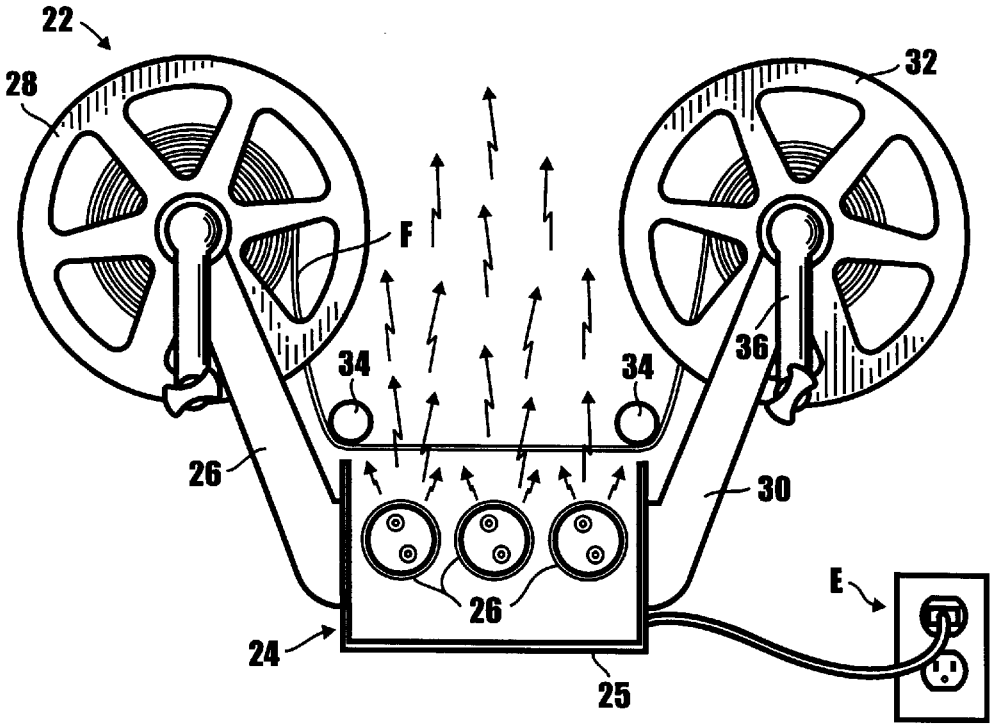
FIG. 2 is a side elevational view of one form of the assemblage of the apparatus for controllably exposing the chemically treated film to light.

Turning to FIG. 2, one form of the assemblage of the apparatus for a controllably exposing the chemically treated film to light is there shown and generally designated by the numeral 22. Assemblage 22 comprises film-exposing means for controllably exposing the multiplicity of images of the motion picture film to light. While various types of devices, well understood by those skilled in the art, can be used to expose the treated film to light, the film exposing means here comprises a light box 24 comprising a housing 25 within which a plurality of light sources 26 are housed. Light sources 26 maybe either fluorescent or incandescent bulbs that are energized by a source of electricity "E" such as a duplex outlet (FIG. 2). Also comprising a part of assemblage 22 is means for controllable passing the filmstrip over the light box. This means here comprises a reel support arm 26 that extends upward from one end of light box 24 and rotatably supports a first reel 28 upon which the treated film has been rolled. A second reel support arm 30 extends upward from the opposite end of light box 24 and functions to rotatably support a second, or take-up reel 32. Idler rollers 34, beneath which the film passes, are rotatably mounted above the light box 24 in the manner shown in FIG. 2. In using assemblage 22, the film "F" is removed from first reel 28, passes beneath rollers 34 and is then wound upon take up reel 32 as the reel is rotated by rotating means which here comprises a rotating crank arm 36. As the film passes over the light box, each frame of the film, and sound track, is exposed to the light sources. It is to be understood, other methods can be employed to expose the film to light, if desired. For example, the film can be projected as it normally is in exhibition, or, sunlight or any other intense light sources can be employed.

Before considering the method of the invention, a brief discussion of film degradation would perhaps be helpful. It is, of course, fundamental that a color motion picture loses much of its appeal if a large portion of its color spectrum disappears. With a passage of time, this type of degradation is particularly pronounced in Eastman color films manufactured between about 1951, and 1983, when the Eastman Kodak Company improved the color stability of the product. The fading of Eastman Color and similar films manufactured by other companies does not occur due to the use of the film, or its exposure to light from projection, but rather through chemical changes occurring in the film's emulsion as it sits in storage year after year. The fading that occurs is not subtle, but rather profound, leaving, typically, a dull red predominating the image, which has a desaturated, washed out appearance. The loss of these colors has heretofore been considered to be irreversible. However, as will become apparent from the discussion that follows, the method of the present invention restores these lost colors, evenly and accurately, to the original film element, resulting in a dramatic improvement in the entertainment and aesthetic value of the films so affected.

In addition to color film degradation, because of the exigencies of motion picture laboratory work, the printing and processing of black and white films has often fallen below what might be considered archive standards. As will be discussed hereinafter, the method of the present invention affords a way by which existing negative and prints can be brought to a higher standard of excellence.

In carrying out one form of the method of the invention a selected mixture of chemicals is first placed into the metal container 14. These chemicals include glycerin (approximately six fluid ounces), calcium hydroxide (approximately two ounces), ammonium sulfate (approximately one ounce), ammonium phosphate (approximately one-half ounce), ammonium dichromate (approximately one quarter ounce), and cupric sulfate (approximately one quarter ounce). The chemicals are stirred lightly to create a volatile chemical solution. This done, a metal spacer, such as support 18 is placed into container 14 and becomes the means for supporting the film to be treated. (an empty 16 mm 1600 feet or 2000 feet metal film reel can be used for this purpose). It is important to note that the film itself should make no direct contact with the chemical solution.

The film to be treated, which can be 35 mm or 16 mm, or other gauge, and up to 2000 feet in length, is wound, rather loosely and emulsion side out, onto a metal reel, such as a reel 19. (In the case of 35 mm films, the heavy-duty reels intended for continuous theater use and known as "house reels" are ideal for this purpose.) Reel 19 is then placed on top of support 18 in the manner shown in FIG. 1. This done, metal cover 20, which has approximately thirty-five fairly even spaced small holes of about ⅛th inch in diameter, is positioned over container 14. Cover 20 is apertured to allow the flow and escape of the chemical fumes generated when the volatile solution "S" is heated. Heating of the solution is accomplished by placing container 14 directly on top of a conductor member, such as a cast iron member 38 (FIG. 1) that is capable of providing an even, low-level heat to the chemical mixture. Member 38 is, in turn, placed on the heating means or heating unit 16 that functions to supply an even, sustained heat to conductor member 38.

At intervals of about twenty to twenty-five minutes during the heating step the top or lid is removed and checked for condensation. Excessive condensation can undesirably cause staining of the film. Therefore, this condensation should be wiped away with a towel or cloth several times during the heating step. After approximately one hour and thirty minutes, reel 19 is removed from container 14 and any condensation buildup is carefully wiped away.

Because ammonia is a heart stimulant, and breathing heavy concentrations of ammonia can be dangerous, the method of the invention should be carried out in a well-ventilated area, ideally with an exhaust fan placed directly above the heated mixture.

After the chemical fuming step, the treated film is wound onto first reel 28 (FIG. 2), with the emulsion side properly positioned for the light exposure that follows. During this important light exposure step of the method of the invention, the film is exposed to intense light. To accomplish this the film is controllably passed one or more times over light box 24, with the emulsion side of the treated film directly facing the light. Compact fluorescent lights, with their low power consumption, relative low heat and high frequency range, are well suited for this purpose. During the light exposure step, light box 24 that contains three General Electric BIAX™ 28 watt fluorescent units is situated between the film rewind means that comprises arms 26 and 30 and reels 28 and 32 so that the film can be wound over the light box to subject the treated emulsion to the light. The effect of the light is to liberate certain chemicals in the film's emulsion thereby setting in motion a "development" of the improved image. The film should be wound over the light box at a moderate speed of approximately sixty feet per minute or less and preferably the exposure should be accomplished two or more times. Alternate light sources include film projectors, or sunlight.

After the light exposure step, the improved image requires several days (generally two to five) to fully develop or "cure". At that time, the process, including the chemical treatment, can be repeated, and then, if necessary, repeated again until the film has been brought to the desired level of image enhancement. There is no need to perform these repeated treatments within any particular time frame and the film can be set aside and then retreated at any time. In the case of Eastman Color films, the more severe the fading, the more treatments will be necessary to effect a satisfactory restoration of color. In the case of black and white films, the lighter the film's image and the lower its density, the more treatments will be needed to give it a rich and full contrast range.

The enhancements achieved by the practice of present invention are not artificial, but rather are genuine amplifications of qualities already held within the films being treated, reflecting the true values of light, shadow, and color of the source materials from which the films were created. The dyes in Eastman Color films are chemically altered by this process to restore them to much improved visibility. Black and white films are improved by the addition of microscopic or sub-microscopic accretions of chromium and copper to their emulsions. These metals form a permanent molecular bond with the silver that comprises the film's picture and sound track.

The improvements achieved in color films are stable and should last for years. If color fading reoccurs at sometime in the future, the process can be repeated and the colors re-enhanced. The improvements in black and white films are stable and permanent. Following treatment, both the color and black and white films can be stored in a conventional manner.

The various methods of the present can be accomplished in accordance with the examples which follow:

EXAMPLE 1

Color

A film dealing with certain sociological aspects of the 1960s is selected for restoration. An examination of the Eastman Color prints of this film reveals that all of the prints are badly faded and do not represent the film as it appeared when first made.

In accomplishing the method of this form of the invention, the selected film is wound, rather loosely emulsion side out, onto a metal reel, such as reel 19. Next, selected chemicals are placed into the metal container 14 and are intermixed. This results in a formulation which comprises a volatile solution having the following components in the following relative proportions:

Between about 2 and about 12 ounces of Glycerin;

Between about: ½ and about 6 ounces of Calcium Hydroxide;

Between about ⅛ and about 2 ounces of Ammonium Phosphate;

Between about 1/16 and about 1 ounce of Ammonium Dichromate; and:

Between about 1/16 and about 1 ounce of Cupric Sulfate

Following the mixing of the components, reel 19 is placed on top of support 18 in the manner shown in FIG. 1. This done, metal cover 20 is positioned over container 14. Cover 20 is apertured to allow the escape of the chemical fumes generated when the volatile solution "S" is heated.

With cover 20 in position, the assemblage is placed directly on top of a conductor member 38 and the heater means is activated to controllably heat the solution to an elevated temperature of between about 100 and about 150 degrees Fahrenheit to cause the solution to at least partially vaporize. The chemical fumes generated as the volatile solution vaporizes will pass around and about the filmstrip and will act upon the emulsion before exiting the assemblage via the apertures formed in cover 20.

After exposure of the film to the chemical fumes for between about ten and about fifty minutes, the treated film is wound onto first reel 28 (FIG. 2), with the emulsion side properly positioned for light exposure during the light exposure step wherein the film is controllably passed one or more times over light box 24, with the emulsion side of the treated film directly facing the light. The film is preferably passed over the light box at a speed of between approximately forty and eighty feet per minute.

After the light exposure step, the improved image is permitted to fully develop or "cure" for a period of two to five days.

Examination of the film following treatment reveals that the skin tones of the film's actors appear natural instead of a washed-out red, and the film exhibits improved contrast and color values.

EXAMPLE 2

Black and White

A black and white feature film is selected that is rather light in density with the faces of actors having an unnaturally bright or white look and the darkest shadow areas in night scenes having a murky gray appearance. Additionally, the artistic lighting effects that are plainly visible in still photographs from the production are hardly discernable.

In accomplishing the method of the invention for treating this black and white film, which is substantially identical to the process for treating color film, the selected film is wound, rather loosely emulsion side out, onto reel 19. Next, as before, the following components in the following relative proportions are intermixed within container 14:

Between about 2 and about 12 ounces of Glycerin;

Between about: ½ and about 6 ounces of Calcium Hydroxide;

Between about 1/16 and about 2 ounces of Ammonium Phosphate;

Between about 1/32 and about 1 ounce of Ammonium Dichromate; and:

Between about 1/32 and about 1 ounce of Cupric Sulfate

Following mixing of the components, reel 19 is placed on top of support 18 in the manner shown in FIG. 1. This done, metal cover 20 is positioned over container 14. With cover 20 in position, the assemblage is placed directly on top of a conductor member 38 and the heater means is activated to controllably heat the solution to an elevated temperature of between about 100 and about 150 degrees Fahrenheit to cause the solution to at least partially vaporize. The chemical fumes generated as the volatile solution vaporizes will pass around and about the black and white film strip and will act upon the emulsion before exiting the assemblage via the apertures formed in cover 20.

After exposure of the film to the chemical fumes for between about ten and ninety minutes, the treated film is wound onto first reel 28 (FIG. 2), with the emulsion side properly positioned for light exposure during the light exposure step wherein the film is controllably passed one or more times over light box 24, with the emulsion side of the treated film directly facing the light. The film is preferably passed over the light box at a speed of between approximately forty and eighty feet per minute.

After the light exposure step, the improved image is once again permitted to fully develop or "cure" for a period of two to five days Examination of the film following treatment reveals that the treatment has created an improved contrast range in the print. On projection, the print revealed a richer, fuller density and many fine details formerly muted in the print are plainly visible.

EXAMPLE 3

Black and White

A black and white feature film is selected that is to be mastered onto the DVD format. However, the optical soundtrack lacks clarity and has a high noise or hiss level. The chemical and light exposure process described in this latest example is used to treat the motion picture print, including its optical soundtrack.

In accomplishing this latest method of the invention, which is, once again, substantially identical to the process for treating color film, the selected film is wound, rather loosely emulsion side out, onto reel 19. Next, the following components in the following relative proportions are intermixed within container 14:

Between about 4 and about 8 ounces of Glycerin;

Between about: ½ and about 3 ounces of Calcium Hydroxide;

Between about 1/8 and about 1 ounce of Ammonium Phosphate; and

Between about 1/16 and about ½ ounce of Ammonium Dichromate.

Following mixing of the components, reel 19 is once again placed on top of support 18 in the manner shown in FIG. 1. This done, metal cover 20 is positioned over container 14. With cover 20 in position, the assemblage is placed directly on top of a conductor member 38 and the heater means is activated to controllably heat the solution to an elevated temperature of between about 105 and about 130 degrees Fahrenheit to cause the solution to at least partially vaporize. The chemical fumes generated as the volatile solution vaporizes will pass around and about the black and white filmstrip and will act upon the emulsion before exiting the assemblage via the apertures formed in cover 20.

After exposure of the film to the chemical fumes for between about fifteen and about ninety minutes, the treated film is wound onto first reel 28 (FIG. 2), with the emulsion side properly positioned for light exposure during the light exposure step wherein the film is controllably passed one or more times over light box 24, with the emulsion side of the treated film directly facing the light. The film is preferably passed over the light box at a speed of between approximately five and fifty feet per minute.

After the light exposure step, the improved image is once again permitted to fully develop or "cure" for a period of two to five days.

Examination of the film following treatment reveals that the treatment has created a higher contrast range in the print revealing many of the fine details that were missing or muted from the film before the treatment. Additionally, the optical track, which had looked rather soft in focus and low in contrast, has sharpened considerably and deepened in its contrast range. Upon playback, the film exhibits greater clarity and a more natural sound. Also, the noise level or hiss had been lowered considerably. This result enables a more satisfactory soundtrack transfer to the DVD format.

EXAMPLE 4

Color

An examination of an Eastman color negative of the film selected for this example reveals that the negative is quite badly faded and does not represent the film as it appeared when first made.

In accomplishing the method of the invention for treating this film, which is quite similar to the process of example 1 for treating positive color film, the selected film is wound, rather loosely emulsion side out, onto reel 19. Next, as before, the following components in the following relative proportions are intermixed within container 14:

Between about 5 and about 9 ounces of Glycerin;

Between about: ½ and about 2½ ounces of Calcium Hydroxide;

Between about ¼ and about ¾ ounce of Ammonium Phosphate;

Between about 1/16 and about ⅓ ounce of Ammonium Dichromate; and:

Between about 1/16 and about ⅓ ounce of Cupric Sulfate

Following the mixing of the components, reel 19 is placed on top of support 18 in the manner shown in FIG. 1. This done, metal cover 20 is positioned over container 14. With cover 20 in position, the assemblage is placed directly on top of a conductor member 38 and the heater means is activated to controllably heat the solution to an elevated temperature of between about 105 and about 140 degrees Fahrenheit to cause the solution to at least partially vaporize. The chemical fumes generated as the volatile solution vaporizes will pass around and about the filmstrip and will act upon the emulsion before exiting the assemblage via the apertures formed in cover 20.

After exposure of the film to the chemical fumes for between about ten and fifty minutes, the treated film is wound onto first reel 28 (FIG. 2), with the emulsion side properly positioned for light exposure during the light exposure step wherein the film is controllably passed one or more times over light box 24, with the emulsion side of the treated film directly facing the light. The film is preferably passed over the light box at a speed of between approximately twenty and fifty feet per minute.

After the light exposure step, the improved image is permitted to fully develop or "cure" for a period of five days.

An examination of a print made from the negative following treatment reveals that the skin tones of the film's actors appear more natural and the film generally exhibits improved contrast and color values.

The chemical composition described in the foregoing examples for the treatment of film can be modified or adjusted to obtain slightly different results in various films. For instance, for treating badly faded color films, it is desirable to maintain, as much as possible, a high concentration of the alkali chemicals, represented by the ammonia group. In addition, severe color fading is most efficiently corrected by the use of cupric sulfate, so more of that chemical, one and one-half the amount used in the basic formula described in example 1, can be employed in treating the worst cases of color fading.

In treating black and white film, especially in cases where the film's density is not too far from that desired, the amount of cupric sulfate specified in the basic formula described in example 2 can be reduced by half or eliminated completely, and ammonium dichromate can be used as the active ingredient for increasing contrast.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of restoring and enhancing film comprising the steps of:

(a) Intermixing selected chemicals to form a volatile solution;

(b) heating said volatile solution to an elevated temperature sufficient to at least partially vaporize said volatile solution to create a vapor;

(c) exposing said film to said vapor to create a treated film; and (d) exposing said treated film to light.

2. The method as defined in claim 1 in which said selected chemicals are selected from the group consisting of glycerin, calcium hydroxide, ammonium phosphate and ammonium dichromate.

3. The method as defined in claim 1 in which said selected chemicals are selected from the group consisting of glycerin, calcium hydroxide, ammonium phosphate, ammonium dichromate and cupric sulfate.

4. The method as defined in claim 1 in which said selected chemicals are selected from the group consisting of between about 5 and about 9 ounces of Glycerin; between about: ½ and about 2½ ounces of Calcium Hydroxide; and between about ¼ and about ¾ ounce of Ammonium Phosphate.

5. The method as defined in claim 1 in which said selected chemicals are selected from the group consisting of between about 5 and about 9 ounces of Glycerin; between about: ½ and about 2½ ounces of Calcium Hydroxide; between about ⅛ about ¾ ounce of Ammonium Phosphate; between about 1/32 and about ⅓ ounce of Ammonium Dichromate; and between about 1/32 and about ⅓ ounce of Cupric Sulfate.

6. The method as defined in claim 1 in which said volatile solution is heated to an elevated temperature of between about 100 and about 150 degrees Fahrenheit.

7. A method of restoring motion picture film comprising the steps of:

(a) preparing a volatile solution selected from the group consisting of glycerin, calcium hydroxide, ammonium phosphate, and ammonium dichromate;

(b) heating said volatile solution to an elevated temperature sufficient to at least partially vaporize said volatile solution to create a vapor;

(c) exposing said motion picture film to said vapor to create a treated motion picture film; and (d) exposing said motion picture film to light.

8. The method as defined in claim 7 in which said group consists of glycerin, calcium hydroxide, ammonium phosphate, ammonium dichromate and cupric sulfate.

9. The method as defined in claim 7 in which said group consists of between about 5 and about 9 ounces of Glycerin; between about: ½ and about 2½ ounces of Calcium Hydroxide; between about ¼ about ¾ ounce of Ammonium Phosphate; between about 1/16 and about ⅓ ounce of Ammonium Dichromate.

10. The method as defined in claim 9 in which said volatile solution is heated to an elevated temperature of between about 105 and about 140 degrees Fahrenheit.

11. The method as defined in claim 9 in which the film is exposed to said vapor for between about ten and about ninety minutes.

* * * * *